US007119296B1

(12) United States Patent
Liu et al.

(10) Patent No.: US 7,119,296 B1
(45) Date of Patent: Oct. 10, 2006

(54) KEYPAD

(75) Inventors: Dean-Kuo Liu, Taoyuan (TW); Lu-Chin Wu, Taipei (TW)

(73) Assignee: Speed Tech Corp., Taoyuan Hsien (TW)

( * ) Notice: Subject to any disclaimer, the term of this patent is extended or adjusted under 35 U.S.C. 154(b) by 0 days.

(21) Appl. No.: 11/162,366

(22) Filed: Sep. 8, 2005

(30) Foreign Application Priority Data

Jun. 29, 2005 (TW) ..... 94121793 A

(51) Int. Cl.
*H01H 3/12* (2006.01)

(52) U.S. Cl. ..... 200/341; 200/512

(58) Field of Classification Search ..... 200/511–517, 200/341, 5 A; 341/22; 345/168, 169, 173
See application file for complete search history.

(56) References Cited

U.S. PATENT DOCUMENTS 4,194,105 A * 3/1980 Hodges ..... 200/517
4,716,262 A * 12/1987 Morse ..... 200/5 A
2002/0196238 A1* 12/2002 Tsukada et al. ..... 345/173
2005/0057515 A1* 3/2005 Bathiche ..... 345/168
2005/0259069 A1* 11/2005 Baker et al. ..... 345/156
2006/0062624 A1* 3/2006 Choi ..... 400/481

* cited by examiner

*Primary Examiner*—Michael Friedhofer
*Assistant Examiner*—Lisa Klaus
(74) *Attorney, Agent, or Firm*—Jiang Chyun IP Office

(57) ABSTRACT

A manufacturing method for a keypad is provided. First, a patterned thin plastic sheet, which includes a first surface and a second surface, is provided. A plurality of touch buttons which can be operated independently are included. The touch buttons have a plurality of hollow patterned structures on them. Later, a metal layer is formed on the first surface of the patterned thin plastic sheet and on the sidewalls of the hollow patterned structures. Thereafter, an adhesion enhancing layer is added onto to the second surface of the patterned thin plastic sheet. Later, a colored layer is formed on the adhesion enhancing layer. Finally, a protruding point layer is formed on the adhesion enhancing layer, and is covering the colored layer. The protruding point layer has a plurality of protruding points with positions corresponding to the touch buttons respectively.

5 Claims, 8 Drawing Sheets

KEYPAD

CROSS-REFERENCE TO RELATED APPLICATION

This application claims the priority benefit of Taiwan application Ser. No. 94121793, filed on Jun. 29, 2005. All disclosure of the Taiwan application is incorporated herein by reference.

BACKGROUND OF THE INVENTION

1. Field of Invention

The present invention relates to a keypad and a manufacturing method thereof. In particular, it relates to a keypad having a high degree of metallic three-dimensionality and a solid touch, and a manufacturing method thereof.

2. Description of Related Art

In today's explosive growth of information technology, electronic devices are having significant impact upon people's lives, especially in portable electronic devices, for example, cellular phone, personal digital assistant, and others. For gaining consumer acceptance, the exterior design for portable electronic device is continuously developing. Although the consumers often consider prices and functionalities during the purchase of portable devices, nevertheless, more and more are focused on the exterior design, thus allowing the exterior design of portable electronic devices to evolve from the original boring rectangular shape slowly into the curved or other different new shapes. For the application in the designs of portable electronic devices, various different designs of keypads have entered the market. However, apart from design considerations, the perception of quality of the keypad is another main criterion for consideration. Typically speaking, although the exterior appearance can be embellished after the plastic keypad undergoes color spray painting, laser engraving, and other processing operations, nevertheless, the effect of metallic luster cannot be achieved.

There is a manufacturing method for a conventional keypad for manufacturing keypad having the effect of metallic luster. FIG. 1A to FIG. 1D illustrate the cross-sectional views of the manufacturing process flow of a conventional keypad. Referring to FIG. 1A, a plastic sheet 110 is first provided in the manufacturing method for a conventional keypad. The plastic sheet 110 has a first surface 112 and a second surface 114, in which a plurality of touchpads 116 which are independently operated are formed on the plastic sheet 110.

Referring to FIG. 1B, a decorative layer 120 is formed on the first surface 112 of the plastic sheet 110. The method for forming the decorative layer 120 is, for example, the deposition of a metal layer using electroplating, spraying of a layer of silver paint, or printing of a material layer having metallic luster using a printing method.

Referring to FIG. 1C, the patterns on the decorative layer 120 are formed by conducting laser engraving or etching fabrication process to the decorative layer 120. By means of using patterns on the decorative layer 120, patterns, numerals, or words are formed on the touchpad 116.

Referring to FIG. 1D, a protruding point layer 130 is formed afterwards on the second surface 114 of the plastic sheet 110. The protruding point layer 130 includes a plurality of protrusions 130*a*, and the position of every protrusion 130*a* corresponds to each of the touchpads 116 respectively. Therefore, a keypad 100 having metallic luster is manufactured.

However, the thickness is thinner for the aforementioned method of forming the decorative layer 120. For example, the thickness of the metal layer formed using electroplating is at most 6 microns (μm), and the thickness of the silver paint layer formed using spraying method is at most 30 microns. If the metallic 3D effects of patterns, numerals, or words are to be formed on the keypad 100, the thickness of the decorative layer 120 has to be at least 400 microns. Therefore, although the conventional keypad 100 may possess metallic luster, it is not able to produce the metallic three-dimensionality and a solid feel.

SUMMARY OF THE INVENTION

Based on the aforementioned, the objective of the present invention is for providing a manufacturing method of a keypad for manufacturing a keypad having a high degree of metallic three-dimensionality and a solid feel.

Another objective of the present invention is for providing a keypad having a high degree of metallic three-dimensionality and a solid feel.

Based on the aforementioned and other objectives, the present invention proposes a manufacturing method of a keypad, which includes the following steps: First, a patterned thin plastic sheet is provided, in which the patterned thin plastic sheet has a first surface and a second surface, and further has a plurality of touch buttons that can be operated independently, wherein a plurality of hollow patterned structures are disposed on the touch buttons. Later, a metal layer is formed on the first surface of the patterned thin plastic sheet and on the sidewall of the hollow patterned structures. An adhesion enhancing layer is disposed on the second surface of the patterned thin plastic sheet. Then, a colored layer is formed on the adhesion enhancing layer. A protruding point layer is formed on the adhesion enhancing layer, and the colored layer is covered. The protruding point layer has a plurality of protrusions, wherein the positions of the protrusions correspond to the touch buttons.

According to the present invention, the manufacturing method of the keypad is described in an embodiment, wherein, for example, a plastic thin film is first provided and followed by the plastic thin film sliced to form the patterned thin plastic sheet in the manufacturing method of the patterned thin plastic sheet.

According to the manufacturing method of the keypad described in an embodiment of the present invention, the method of forming the metal layer, for example, includes physical or chemical thin film coating.

According to the manufacturing method of the keypad described in an embodiment of the present invention, the method of forming the metal layer, for example, includes spraying, electroplating, sputtering or vapor deposition.

According to the manufacturing method of the keypad described in an embodiment of the present invention, the method of forming the colored layer, for example, includes printing, transfer printing or spraying.

According to the manufacturing method of the keypad described in an embodiment of the present invention, the method of forming the protruding point layer, for example, includes injection molding or compression molding.

According to the manufacturing method of the keypad described in an embodiment of the present invention, wherein during the protruding point layer is formed, for example, a portion of the adhesion enhancing layer is further included to be inserted into the hollow patterned structures.

According to the manufacturing method of the keypad described in an embodiment of the present invention, wherein after the protruding point layer is formed, for example, the removal of the excess portions on the exterior perimeter of the patterned thin plastic sheet is further included.

The present invention proposes a keypad, which includes a patterned thin plastic sheet, a metal layer, an adhesion enhancing layer, a colored layer, and a protruding point layer. The patterned thin plastic sheet has a first surface and a second surface. A plurality of touch buttons that are independently operated are included, wherein a plurality of hollow patterned structures are on the touch buttons. The metal layer is disposed on the first surface of the patterned thin plastic sheet and on the sidewall of the hollow patterned structure. The adhesion enhancing layer is disposed on the second surface of the patterned thin plastic sheet. The colored layer is disposed on the adhesion enhancing layer. The protruding point layer is disposed on the adhesion enhancing layer, and is covering the colored layer. This protruding point layer includes a plurality of protrusions, wherein the positions of the protrusions correspond to the touch buttons respectively.

According to the keypad described in an embodiment of the present invention, a portion of the adhesion enhancing layer, for example, is further filled inside the hollow patterned structures.

According to the keypad described in an embodiment of the present invention, the material of the adhesion enhancing layer, for example, includes thermoplastic polyurethane (TPU), thermal plastic rubber (TPR), or thermoplastic resin.

According to the keypad described in an embodiment of the present invention, the material of the protruding point layer, for example, includes thermoplastic elastomer.

According to the keypad described in an embodiment of the present invention, the material of the protruding point layer material, for example, includes silicone rubber, thermoplastic polyurethane (TPU), thermal plastic rubber (TPR), or thermoplastic resin.

In summary, because the metal layer is disposed on the first surface of the patterned thin plastic sheet and then on the sidewall of the hollow patterned structure in the present invention for the keypad and the manufacturing method thereof, the hollow patterns of the keypads have metallic three-dimensionality and a solid feel.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
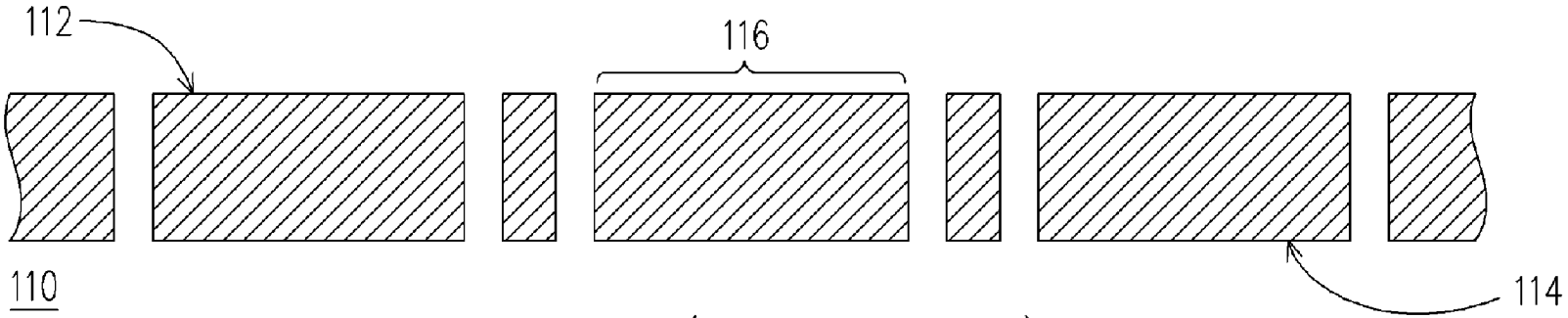
FIG. 1A(PRIOR ART)
FIG. 1A to FIG. 1D illustrate a plurality of cross-sectional views of the manufacturing process flow of a conventional keypad.
Figure 1B:
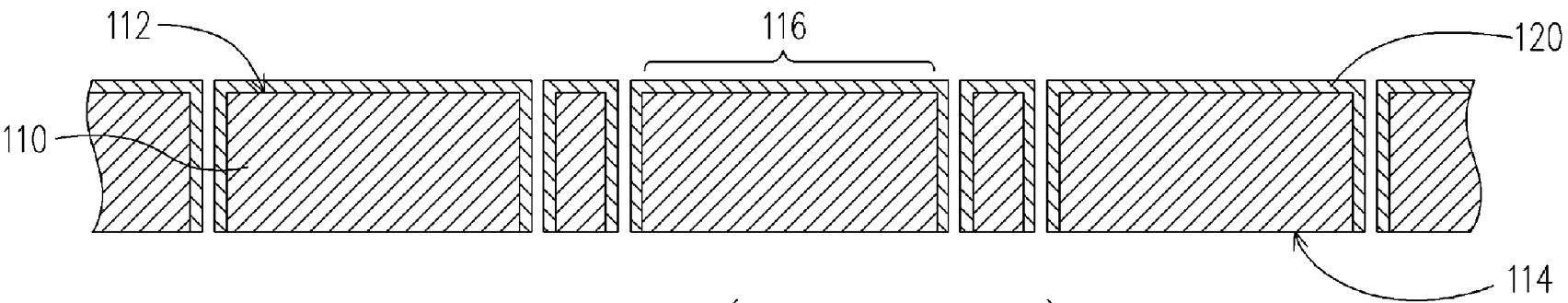
FIG. 1B(PRIOR ART)
Figure 1C:
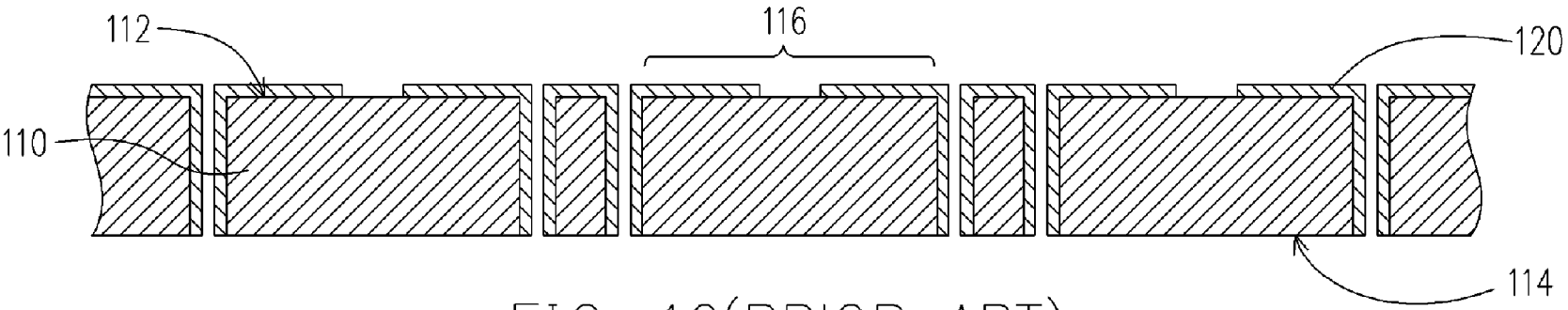
FIG. 1C(PRIOR ART)
Figure 1D:
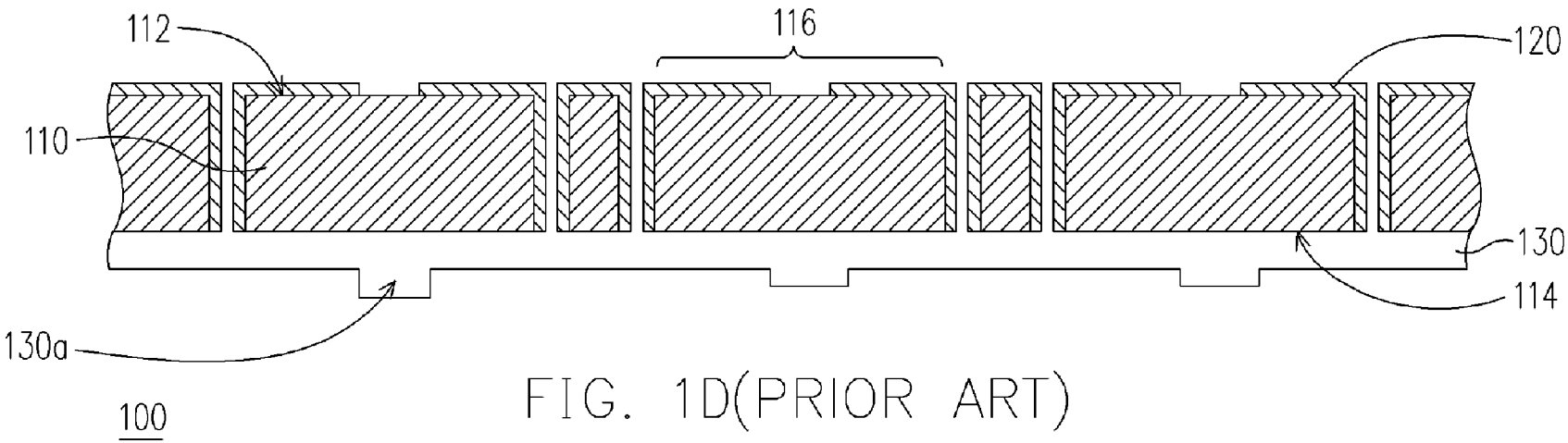
FIG. 1D(PRIOR ART)
Figure 2:
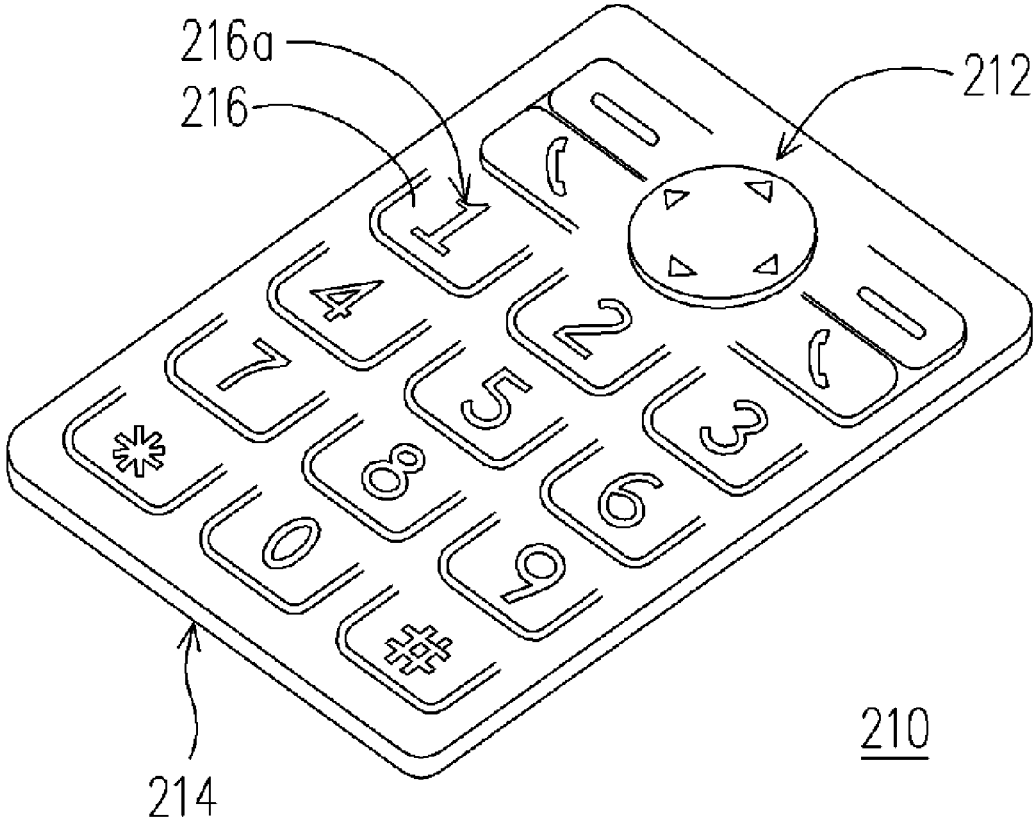
FIG. 2 illustrates a three-dimensional schematic diagram of a patterned thin plastic sheet.

FIG. 2 is a three-dimensional schematic diagram illustrating a patterned thin plastic sheet. Furthermore, FIG. 3A to FIG. 3E illustrate a plurality of cross-sectional views of the process flow of the manufacturing method of the keypad, according to an embodiment of the present invention.

Figure 3A:
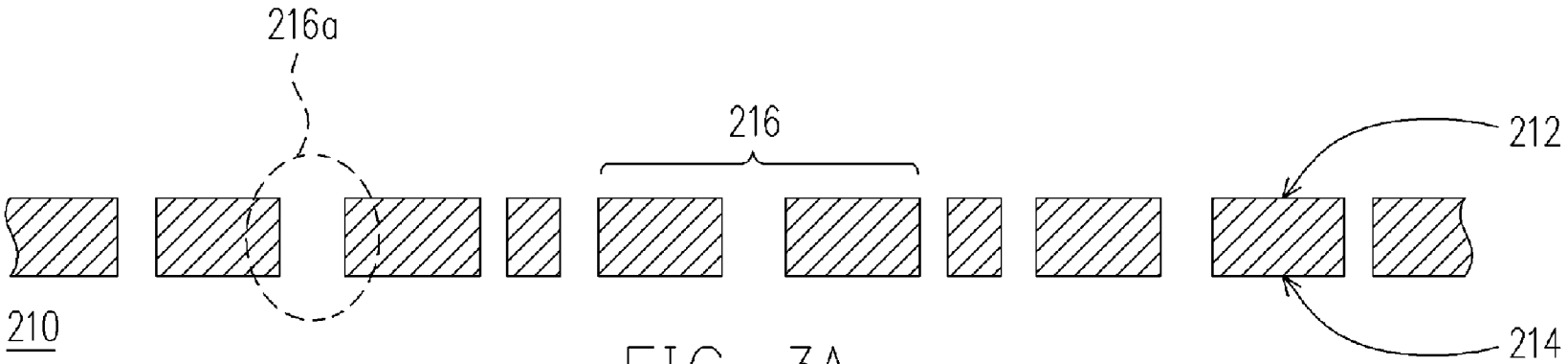
FIG. 3A to FIG. 3E illustrate a plurality of cross-sectional views of the manufacturing process flow of the keypad, according to an embodiment of the present invention.

Referring to FIG. 2 and FIG. 3A, a patterned thin plastic sheet 210 is first provided in the manufacturing method for the keypad in the present embodiment. An intact or uncut plastic thin film (not shown) is provided, for example, in the manufacturing method for the patterned thin plastic sheet 210. Afterwards it is cut into pieces, and the plastic thin film is patterned and formed into the patterned thin plastic sheet 210. The patterned thin plastic sheet 210 has a first surface 212 and a second surface 214, and it includes a plurality of touch buttons 216 that are independently operated. In addition, it has a plurality of hollow patterned structures 216*a* on the touch buttons 216. Specifically, there exists at least one hollow patterned structure 216*a* on each touch button 216.

Figure 3B:
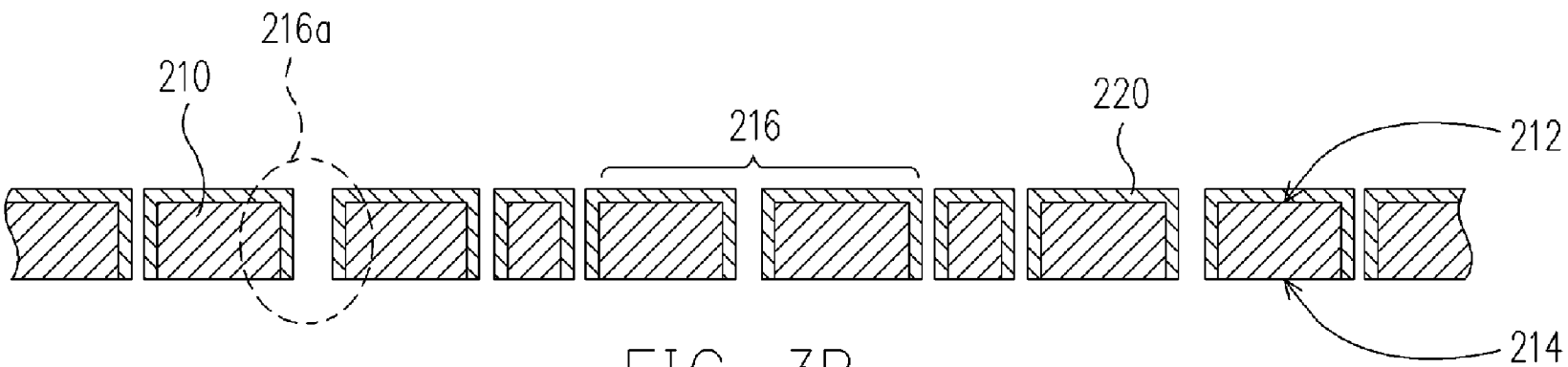

Referring to FIG. 3B, a metal layer 220 is later formed on the first surface 212 of the patterned thin plastic sheet 210 and on the sidewall of the hollow patterned structure 216*a*. The method for forming the metal layer 220, for example, includes physical vapor deposition (PVD) thin film coating, chemical vapor deposition (CVD) thin film coating, spraying, electroplating, sputtering, vapor deposition, or other appropriate methods.

Figure 3C:
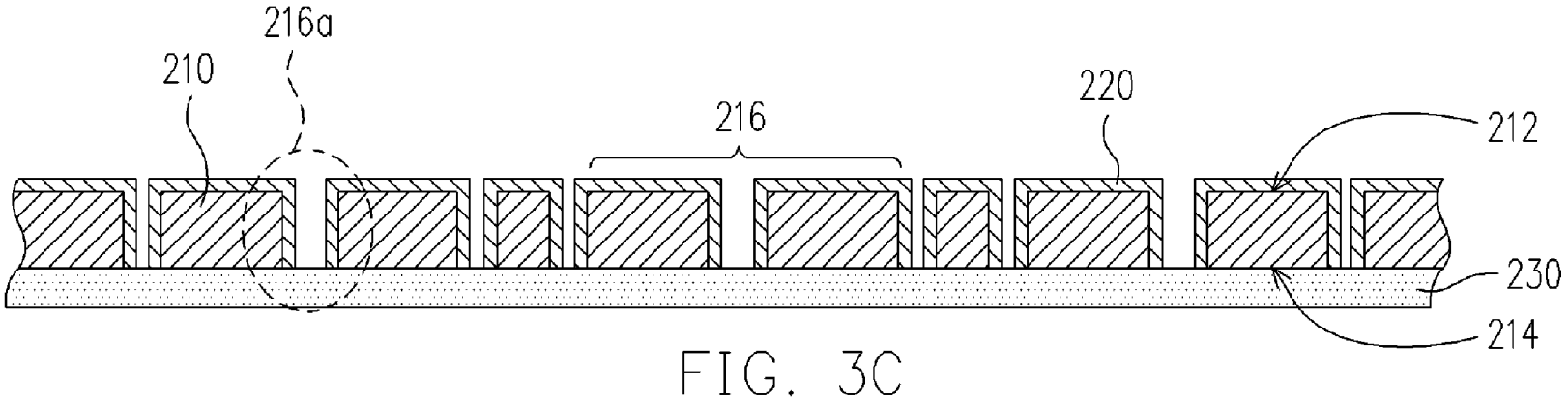

Referring to FIG. 3C, an adhesion enhancing layer 230 is later disposed on the second surface 214 of the patterned plastic sheet 210. The material of the adhesion enhancing layer 230, for example, includes thermoplastic polyurethane, thermal plastic rubber, thermoplastic resin, or other suitable materials.

Figure 3D:
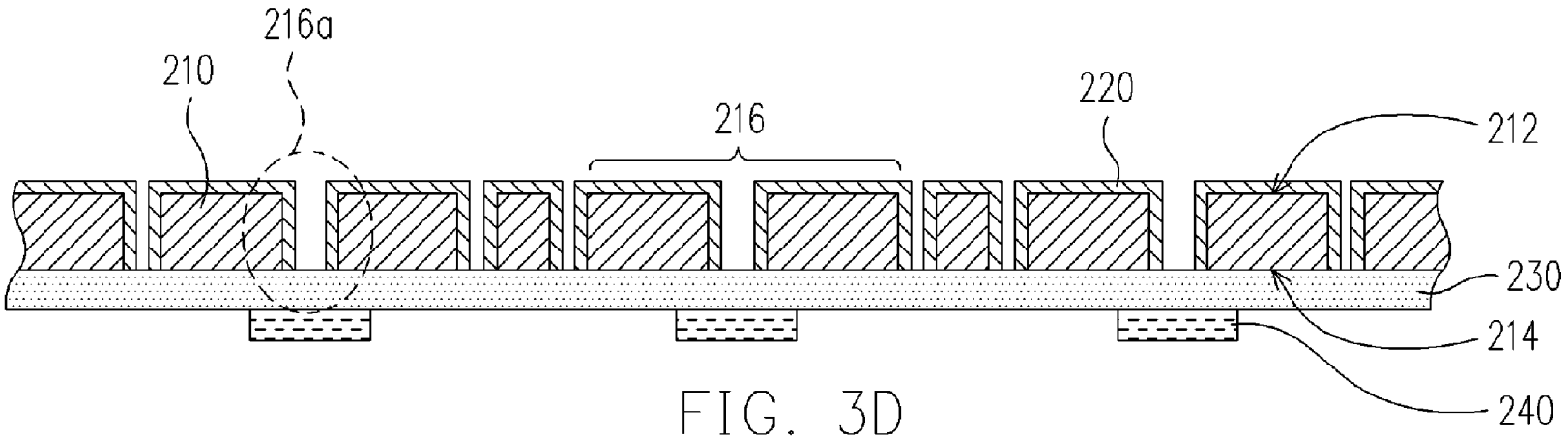

Referring to FIG. 3D, a colored layer 240 is then formed on an adhesion enhancing layer 230. The method for forming the colored layer 240, for example, includes printing, transfer printing, spraying, or other suitable methods. Furthermore, the colored layer 240 is not limited to a single color but, according to specific needs, can be adjusted to adopt a plurality of colors, and the distribution method of each color also is not limited per se.

Figure 3E:
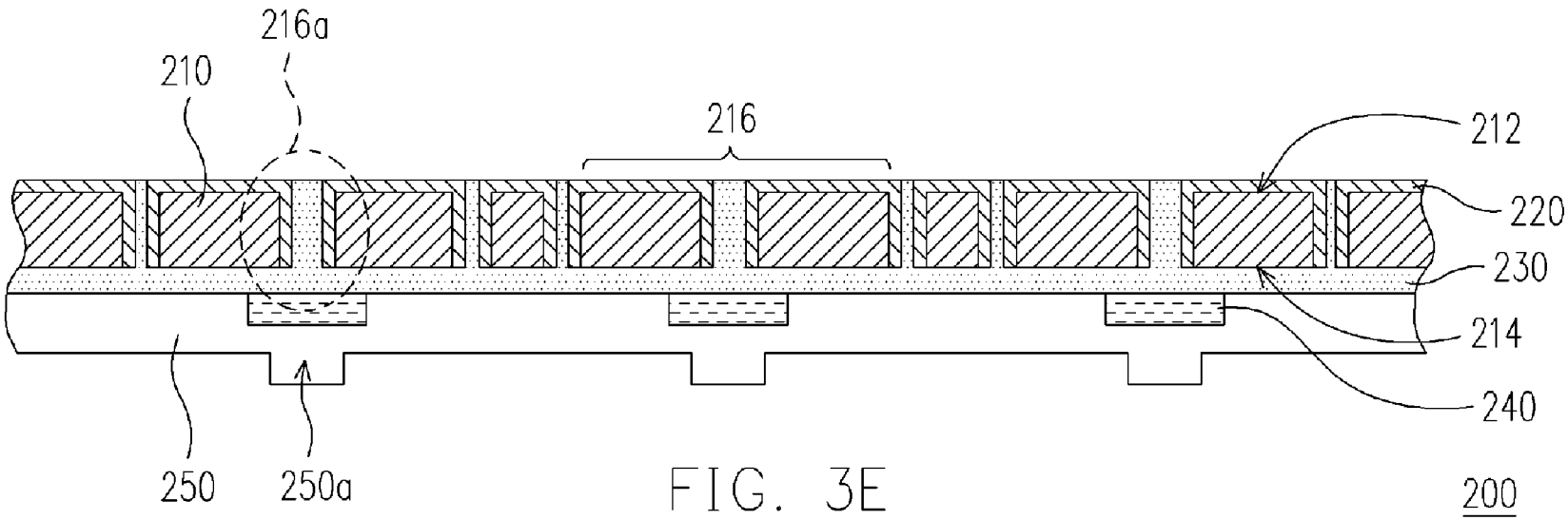

Referring to FIG. 3E, a protruding point layer 250 is formed on the adhesion enhancing layer 230 and is covering the colored layer 240. The protruding point layer 250 has a plurality of protrusions 250*a*, and the position of the protrusions 250*a* correspond to the position of each touch button 216 respectively. The method of forming the protruding point layer 250, for example, includes injection molding, compression molding, or other suitable methods. The material of the protruding point layer 250, for example, includes thermoplastic elastomer, silicone rubber, thermoplastic polyurethane, thermal plastic rubber, thermoplastic resin, or other suitable materials. As a result, the manufacturing of the keypad 200 is almost completed.

In addition, while the protruding point layer 250 is formed, a portion of the adhesion enhancing layer 230 can still be taken to be insert into the hollow patterned structures 216*a* for preventing the accumulation of dirt inside the hollow patterned structure 216*a*. Furthermore, after the protruding point layer 250 is formed, excess portions of the exterior perimeter of the patterned thin plastic sheet 210 are removed depending upon design requirements.

The following is a detailed description of the structure and function of each portion of the keypad 200. Referring to FIG. 3E, the keypad 200 in the present embodiment includes a patterned thin plastic sheet 210, a metal layer 220, an adhesion enhancing layer 230, a colored layer 240, and a protruding point layer 250. The patterned thin plastic sheet 210 has a first surface 212 and a second surface 214, and it includes a plurality of independently operating touch buttons 216, wherein a plurality of hollow patterned structures 216*a* are on the touch buttons 216.

The metal layer 220 is disposed on the first surface 212 of the patterned thin plastic sheet 210 and on the sidewall of the hollow patterned structures 216*a*. Furthermore, the thickness of the metal layer 220 can reach above 400 microns. Because a layer of the metal layer 220 is both on the first surface 212 of the patterned thin plastic sheet 210 and on the sidewall of the hollow patterned structures 216*a*, the keypad 200, therefore, not only has the effect of metallic luster, but also has the hollow patterned structure 216*a* further has metallic three-dimensionality and a solid feel.

The adhesion enhancing layer 230 is disposed on the second surface 214 of the patterned thin plastic sheet 210. The colored layer 240 is disposed on the adhesion enhancing layer 230. The protruding point layer 250 is disposed on the adhesion enhancing layer 230 and is covering the colored layer 240. The protruding point layer 250 has a plurality of protrusions 250*a*, wherein the positions of the protrusions 250*a* correspond to the touch buttons 216 respectively.

Remarkably, if the protruding point layer 250 is directly disposed on the second surface 214 of the patterned thin plastic sheet 210, the adhesion to the patterned thin plastic sheet 210 is inferior; therefore, the adhesion enhancing layer 230 is first formed on the second surface 214 of the patterned thin plastic sheet 210 in the present embodiment. The adhesion between the patterned thin plastic sheet 210 and the adhesion enhancing layer 230 and between the protruding point layer 250 and the adhesion enhancing layer 230 are sufficient; therefore, improper adhesion issues between the protruding point layer 250 and the patterned thin plastic sheet 210 can be resolved. Furthermore, because the colored layer 240 is not easily directly adhered to the patterned thin plastic sheet 210, the adhesion for the enhancing layer 230 can also be used as the base for adhesion for the colored layer 240.

Figure 4:
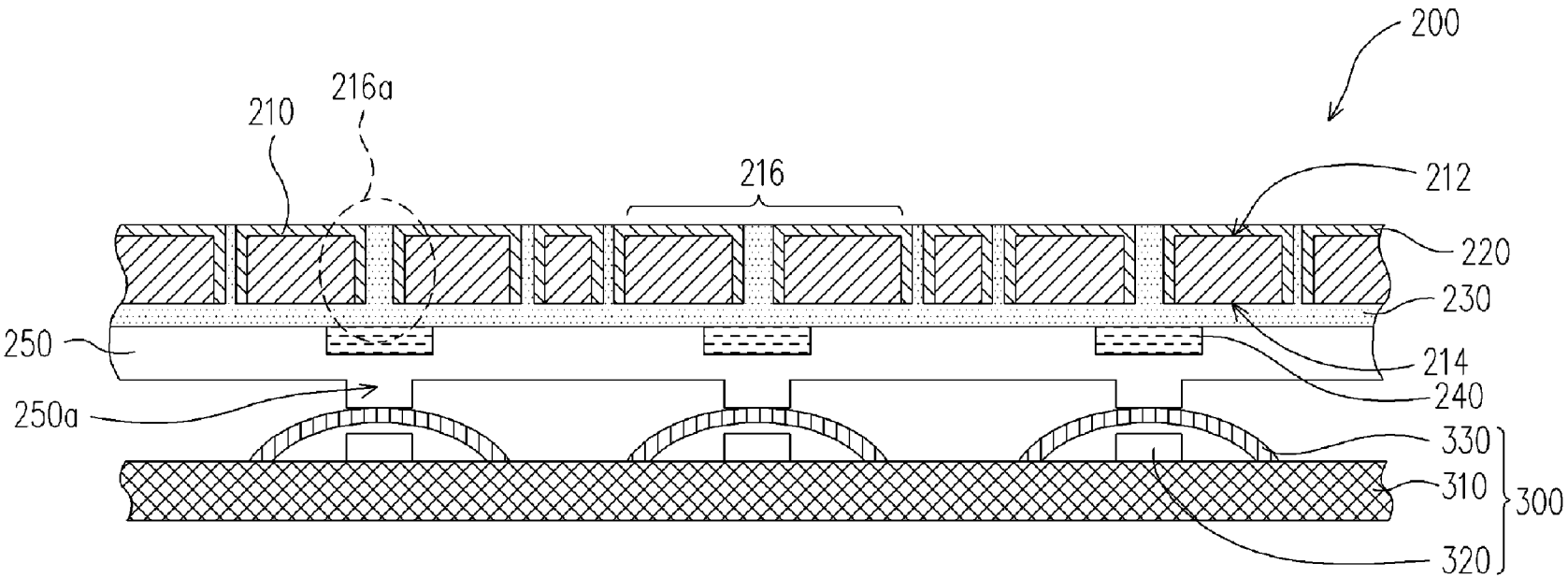
FIG. 4 illustrates a schematic diagram for the assembling of the keypad and the touchpad circuit board, according to an embodiment of the present invention.

FIG. 4 illustrates a schematic diagram of an assembly of a keypad and a touchpad circuit board of an embodiment of the present invention. The keypad 200 is disposed above the touchpad circuit board 300. The touchpad circuit board 300 includes a circuit board 310, a plurality of fixed contacts 320, and a plurality of metal domes 330. The fixed contacts 320 and the metal domes 330 are both disposed on the circuit board 310. Each metal dome 330 is disposed above a corresponding fixed contact 320, but without touching the fixed contact 320. Each of the protrusions 250*a* of the protruding point layer 250 is able to contact with the metal dome 330 as the user presses the touch button 216 respectively. The protrusion 250*a* corresponding to the touch button 216 is to press the metal dome 330, and the metal dome 330 and the fixed contact 320 are made to contact. Using the contact between the metal dome 330 and the fixed contact 320, the user can enter data into cellular phone, personal digital assistant, and other portable electronic devices.

Figure 5:
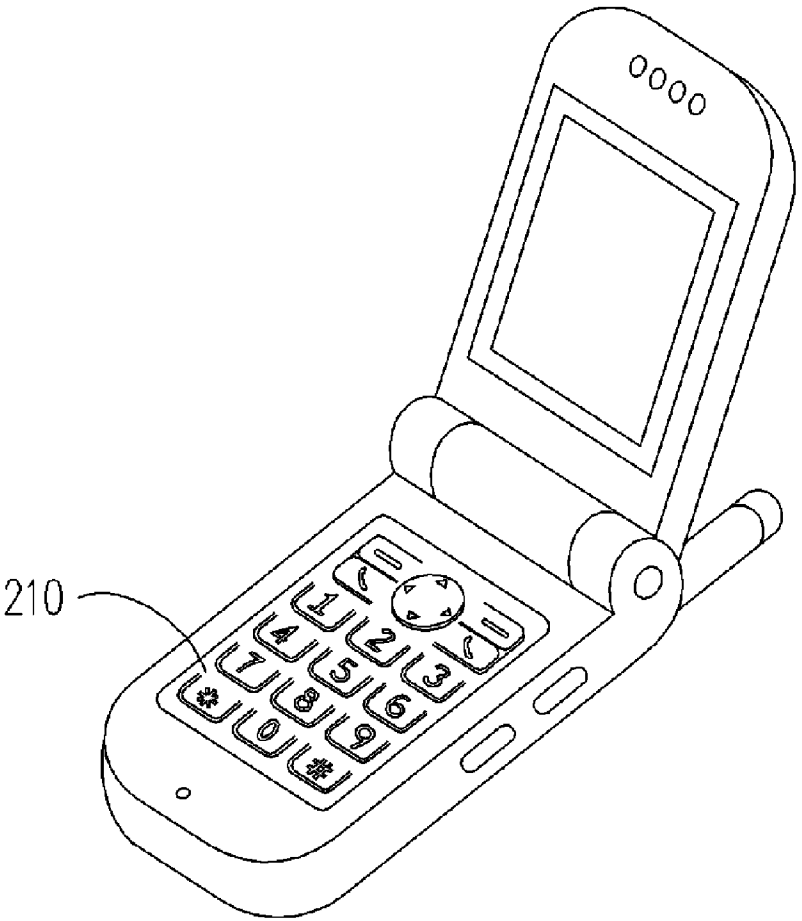
FIG. 5 illustrates a schematic diagram of the cellular phone using the manufactured keypad, according to an embodiment of the present invention.

FIG. 5 illustrates a schematic diagram of the manufacturing of keypad for cellular phone, according to an embodiment of the present invention. The keypad not only has metallic luster but also has metallic three-dimensionality and a solid feel. As a result, the aesthetics of the cellular phone manufactured using the keypad according to an embodiment of the present invention is greatly improved.

In addition, the keypad of the present embodiment is not limited to the manufacturing of cellular phone, the keypad for the present embodiment can fit the needs of other portable electronic devices for improving the aesthetics of the portable electronic device.

In summary, the keypad and the manufacturing method of the present invention include at least the following advantages.

1. The metal layer is disposed on the first surface of the patterned thin plastic sheet of the present invention and on the sidewall of the hollow patterned structure; therefore, the keypad of the present invention not only has metallic luster, but also has metallic three-dimensionality and a solid feel.

2. The present invention adopts a plastic thin film for manufacturing the keypad, which is suitable for laser engraving for forming patterns; therefore, the preferred effects of laser engraving is achievable.

3. In comparison to the more expensive manufacturing process of the keypad using metal thin film of higher purity, the present invention adopts to manufacture the keypad using plastic thin films of reduced cost. In addition, the etching and electroplating costs in the manufacturing process are reduced, thus the overall manufacturing cost for the keypad is also reduced.

It will be apparent to those skilled in the art that various modifications and variations can be made to the structure of the present invention without departing from the scope or spirit of the invention. In view of the foregoing descriptions, it is intended that the present invention covers modifications and variations of this invention if they fall within the scope of the following claims and their equivalents.

What is claimed is:

1. A keypad, comprising:

a patterned thin plastic sheet, having a first surface and a second surface, and the patterned thin plastic sheet comprising a plurality of touch buttons that are independently operated, wherein a plurality of hollow patterned structures are on the touch buttons;

a metal layer, disposed on the first surface of the patterned thin plastic sheet and on the sidewall of the hollow patterned structures;

an adhesion enhancing layer, disposed on the second surface of the patterned thin plastic sheet; a colored layer, disposed on the adhesion enhancing layer; and a protruding point layer, disposed on the adhesion enhancing layer and covering the colored layer, wherein the protruding point layer has a plurality of protrusions and positions of the protrusions correspond to the touch buttons respectively.

2. The keypad in claim 1, wherein a portion of the adhesion enhancing layer further fills into the hollow patterned structures.

3. The keypad in claim 1, wherein a material for the adhesion enhancing layer comprises thermoplastic polyurethane (TPU), thermal plastic rubber (TPR), or thermoplastic resin.

4. The keypad in claim 1, wherein a material for the protruding point layer comprises thermoplastic elastomer.

5. The keypad in claim 1, wherein a material for the protruding point layer comprises silicone rubber, thermoplastic polyurethane, thermal plastic rubber, or thermoplastic resin.

* * * * *